United States Patent [19]

Konstantinov et al.

[11] 3,940,813

[45] Mar. 2, 1976

[54] COLLAPSIBLE TRAILER BOAT

[76] Inventors: Alexei Kirillovich Konstantinov, ulitsa Svobody, 15, kv. 86; Vladimir Vasilievich Volkov, ulitsa Svobody, 15, kv. 52; Viktor Petrovich Gaschenko, Bolshoi Prospekt, 46, kv. 45; Igor Vladimirovich Lukashkov, Bolshoi Prospekt, 46, kv. 30; Alexandr Abramovich Klitsov, Karantinnaya ulitsa, 86; Valentin Timofeevich Kuzmenko, Prokhladnaya ulitsa, 5, kv. 14, all of Taganrog, U.S.S.R.

[22] Filed: Nov. 7, 1974

[21] Appl. No.: 521,897

[30] Foreign Application Priority Data

Nov. 13, 1973 U.S.S.R. ..... 1966005

[52] U.S. Cl. ..... 9/2 C; 114/66.5 R

[51] Int. Cl.[2] ..... B63B 7/04; B63B 1/20

[58] Field of Search ..... 9/2 R, 2 F, 2 S, 1 R, 1 T, 9/2 C; 114/77 R, 66.5 P, 66.5 R

[56] References Cited

UNITED STATES PATENTS

| | | | |
|---|---|---|---|
| 2,266,661 | 12/1941 | Smith | 9/2 F |
| 2,659,464 | 11/1953 | Sweetman | 9/2 F |
| 3,090,973 | 5/1963 | Levinson | 9/1 T |
| 3,121,238 | 2/1964 | Levinson | 9/1 R |

*Primary Examiner*—George E. A. Halvosa
*Assistant Examiner*—Sherman D. Basinger
*Attorney, Agent, or Firm*—Haseltine, Lake & Waters

[57] ABSTRACT

A collapsible trailer boat comprising a fore part and an after part jointed together in such a manner that they can be folded to form a trailer by pivotally moving the fore part in the longitudinal centerplane until it rests, with its bottom up, on the after part. The hull of the after part is shaped with a flat deadrise and has provision for mounting an outboard motor, a retractable undercarriage and a removable towbar. The fore part is detachable and adapted for use as a separate craft, the hull thereof being constructed in the form of a planing catamaran. To use the boat, the portion of the catamaran tunnel adjacent to the after part is closed with a removable hydroplate adapted to match the shape of the catameran bottom to the shape of the bottom of the after part and to form a transverse step at the junction of the fore and after parts, a gap being provided at the step for water to be drawn from the catamaran tunnel when the craft is planing. The fore part of the collapsible trailer boat can be used as a separate craft with an outboard motor. The after part can be used on land as a single-room home. The complete boat can be used both as a craft and as a two-room home on land.

4 Claims, 17 Drawing Figures

COLLAPSIBLE TRAILER BOAT

The invention relates to transport means, more particularly to collapsible boats arranged for use as a motor vehicle trailer, which boats have of late found wide use in recreational motoring owing to their high mobility with consequent increase of recreation opportunities and improvements in comfort. Since basic recreation areas are frequently located near a body of water, such boats gain ever growing popularity.

Well known are collapsible trailer boats having a hull made up of a considerably large number of transverse or longitudinal structural units jointed by means of fastenings.

Such boats suffer from the disadvantage that they need a large amount of assembly work, which complicates their use. Another disadvantage is that for constructional reasons they lack comfort.

Also known in the art are floating trailer homes designed to be hauled by trucks or towing vehicles. As a rule, they are heavy and unwieldy and it is difficult to put them afloat, get ashore or store in urban conditions.

Also known in the art are collapsible trailer boats wherein the disadvantages mentioned above are eliminated.

The hull of said boats is made up of a fore part and an after part, said parts being jointed in such a manner that they can be folded to form a trailer by pivotally moving the fore part in the longitudinal centerplane until it rests, with its bottom up, on the after part. The after part of the hull is adapted for mounting an outboard motor, a removable or retractable undercarriage and a towbar. Both the fore and after parts of the hull are shaped with a deadrise.

The collapsible boats under consideration require less assembly work and provide more comfort inasmuch as one of the hull parts is adapted to accommodate a folding superstructure arranged for erection simultaneously with unfolding the trailer to make a boat.

Such boats suffer, however, from substantial disadvantages, viz.: the parts of the boat are arranged as merely structural components and cannot be used separately for recreational purposes; such boats are not adapted for use as a camping home on land.

It is an object of the present invention to provide a collapsible trailer boat having one part thereof adapted to be used separately as a boat and the other part adapted for use as a camping home on land.

It is a further object of the present invention to provide a collapsible trailer boat arranged to be used bodily as a planing craft with an outboard motor and adapted to be converted into a two-room home for use on land.

These and other objects are achieved in a collapsible trailer boat comprising a fore part and an after part jointed together in such a manner that they can be folded to form a trailer by pivotally moving the fore part in the longitudinal centerplane until it rests, with its bottom up, on the after part. The hull of said after part is shaped with a flat deadrise and has provision for mounting an outboard motor, a retractable undercarriage and a removable towbar. According to the invention, the fore part is detachable and adapted for use as a separate craft, the hull thereof being constructed in the form of a planing catamaran. To use the boat bodily, the portion of the catamaran tunnel adjacent to the after part is closed with a removable hydroplate adapted to match the shape of the catamaran bottom to the shape of the bottom of the after part and to form a transverse step at the junction of said fore and after parts, a gap being provided at the step for water to be drawn from the tunnel when the craft is planing.

The fore part can be used as a separate craft. By virtue of it being constructed in the form of a planing catamaran, this craft, despite its low length-breadth ratio, possesses good transverse stability, its seagoing ability and permissible outboard motor power being higher than those a single-hull vessel having an equal length.

With the outboard motor transferred from the after part onto the fore part, the latter can be used independently as a planing catamaran, whilst the after part can be used on land as a single-room home.

When the trailer boat is used bodily, the employment of the hydroplate in the catamaran tunnel imparts to the complete hull a planing form. The transverse step and the gap formed by the hydroplate at the junction of the fore and after parts allow water to be drawn from the catamaran tunnel, thereby improving the seagoing qualities of the craft in planing.

Being detachable, the fore and after parts of the boat can be put afloat separately and thereafter jointed. This detachability feature is also helpful in getting the boat ashore.

According to one of the embodiments of the invention, a transom board is attached to the stern of the catamaran for the purpose of mounting an outboard motor and two removable antisquat boards are positioned substantially level with the catamaran bottom, one on each side of the tunnel, in order to improve the longitudinal stability of the craft. When the boat is used bodily, said antisquat boards are to be employed as a portion of the catamaran deck planking.

The employement of an outboard motor makes it possible to use the catamaran for motorboating sports and for towing applications in hydroskiing. The antisquat boards improve the longitudinal stability of the catamaran in planing. If constructed to produce sufficient displacement, said antisquat boards also improve the longitudinal stability of the catamaran when it is stationary and the boater is at the motor in the stern (extreme aft load distribution) or when the vessel's wave is overtaking the craft after abrupt stopping.

Owing to positive buoyancy, the antisquat boards do not sink if dropped into the water. They can also be used as part of the deck planking in order to reduce the weight of the boat assembly.

It is desirable that the hydroplate be made hollow, its under side be shaped with a deadrise increasing toward the after part and the upper side be flat so that the hydroplate may be used ashore as a tabletop.

The shape of the hydroplate under side described above makes it possible to match the flat bottom of the catamaran tunnel to the deadrise bottom of the boat after part at the junction between the fore and after parts, whereby the total hydraulic resistance of the boat bottom is reduced.

Being hollow and watertight, the hydroplate has positive buoyancy and does not sink if dropped into the water. It can also be used as an aid in learning to swim.

The fore and after parts of the boat can be coupled by means of two upper separable joints, each comprising a hock-shaped yoke, and two lower separable attachment fittings employing swinging bolts.

This constructional arrangement makes it possible to rapidly detach the fore part from the after part so that they can be used separately according to the invention.

In folding up the trailer boat, the fore part is turned about the upper joints and is thus readily orientated relative to the after part. Said joints also facilitate the orientation of the boat parts when unfolding them to make up the boat.

Now the invention will be described in detail with reference to the accompanying drawings in which.

Figure 1:
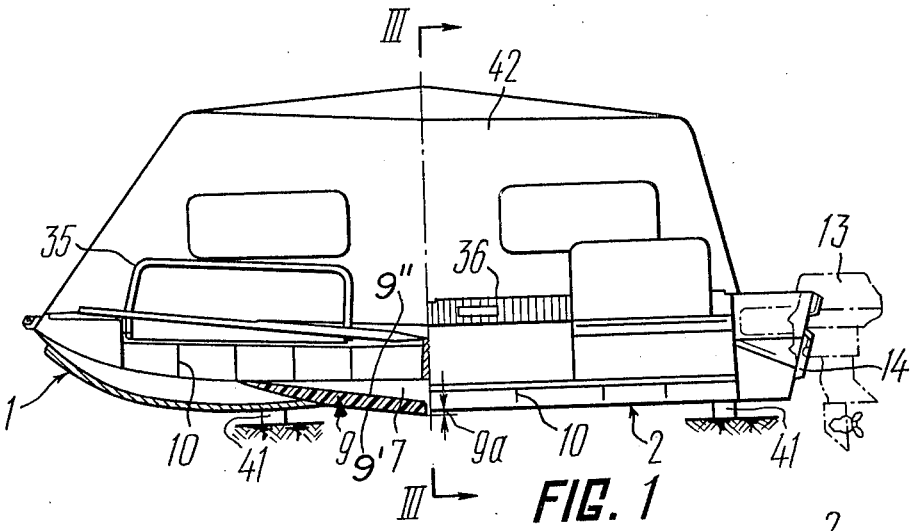
FIG. 1 is a longitudinal sectional view of the collapsible trailer boat complete with a tent.

The collapsible trailer boat which constitutes the present invention has a planing hull composed of a fore part 1 (FIGS. 1 and 2) and an after part 2 jointed together in such a manner that they can be folded to form a trailer 3 (FIGS. 4 through 6) by pivotally moving the fore part 1 in the longitudinal centerplane until it rests, with its bottom up, on the after part 2.

The hull of the after part 2 is adapted for a retractable undercarriage 4 (FIGS. 3 through 6) to be mounted on sides 2*a* and has provision for attaching a towbar 3 to a front wall 2*b*.

The bottom 6 (FIG. 3) of the after part 2 is formed with a flat deadrise.

According to the invention, the fore part 1 is detachable and adapted for use as a separate craft, the hull thereof being constructed in the form of a planing catamaran (hereinafter the fore part of the boat will also be referred to as a catamaran).

Figure 9:
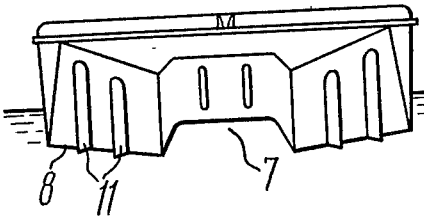
FIG. 9 is a front view of the fore part (catamaran).
Figure 10:
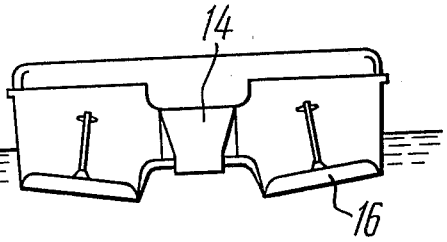
FIG. 10 is a rear view of the fore part (catamaran).

The bottom of the catamaran 1 has an axial tunnel 7 (FIGS. 1 and 9) of trapezoidal cross section. The portions 8 of the catamaran bottom at each side of the tunnel are shaped to match the flat deadrise shape of the bottom 6 of the after part 2 where the fore part 1 and the after part 2 meet.

Figure 11:
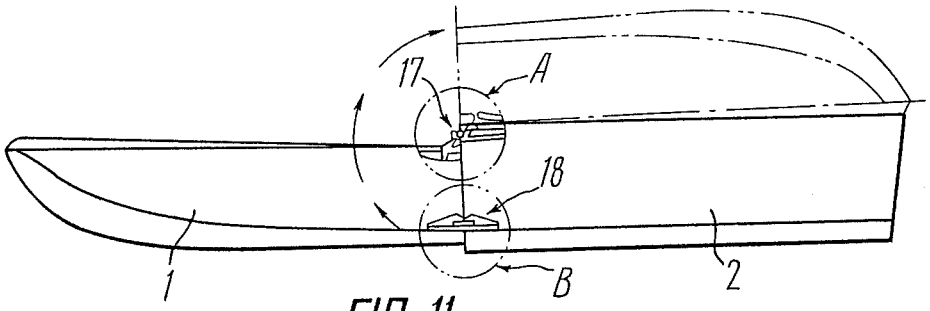
FIG. 11 is a side view of the complete boat showing the joints and attachment fittings.
Figure 12:
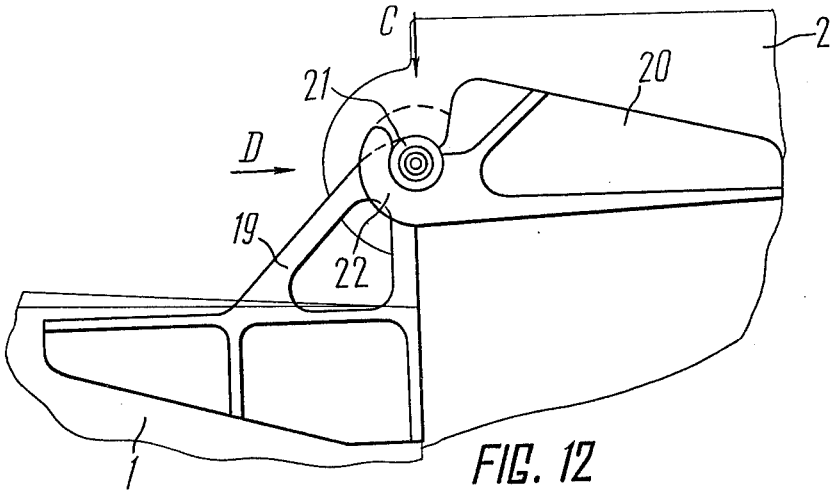
FIG. 12 is detail A of FIG. 11 showing the upper separable joint (enlarged).
Figure 13:
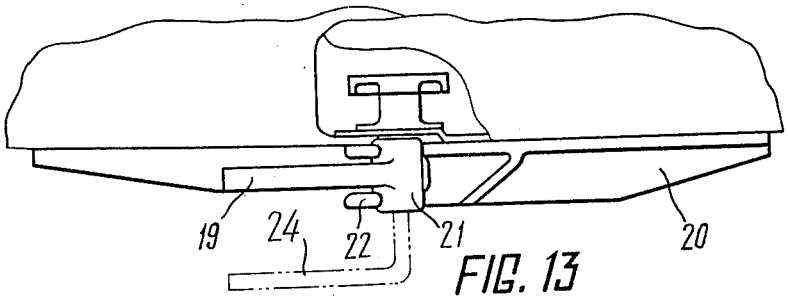
FIG. 13 is a view in the direction of the arrow C in FIG. 12.

To maintain the planing form of the complete hull when using the boat bodily, the portion of the catamaran tunnel 7 adjacent to the after part 2 is closed with a removable hydroplate 9 (FIGS. 1 and 11) which is shaped so as to match the form of the bottom of the catamaran 1 to the form of the bottom of the after part 2.

Said hydroplate 9 is arranged to form a transverse step 9a at the junction of the fore part 1 and the after part 2, a gap being provided at said step for water to be drawn from the tunnel 7 when the complete craft is planing.

Figure 5:
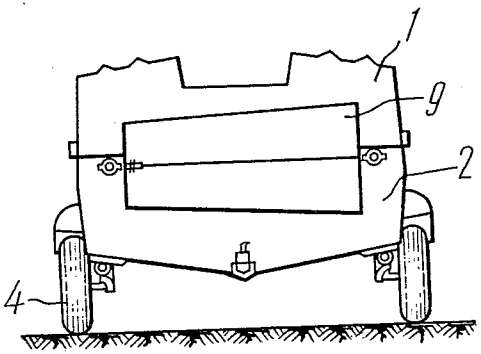
FIG. 5 is a front view of the boat folded to form a trailer.
Figure 6:
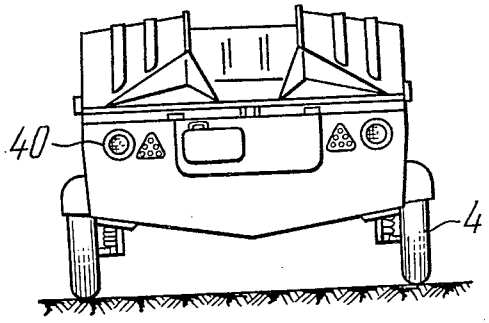
FIG. 6 is a rear view of the boat folded to form a trailer.
Figure 4:
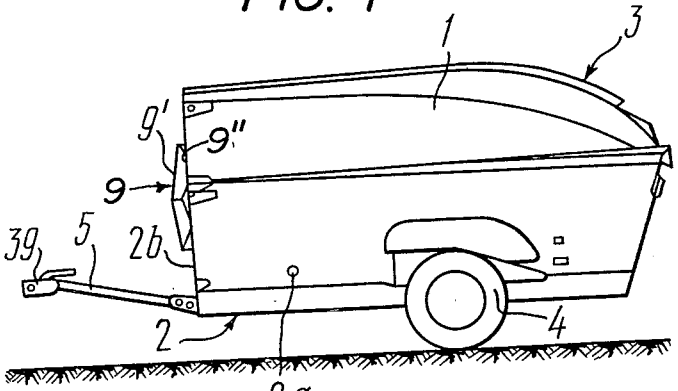
FIG. 4 is a side view of the boat folded to form a trailer.
Figure 17:
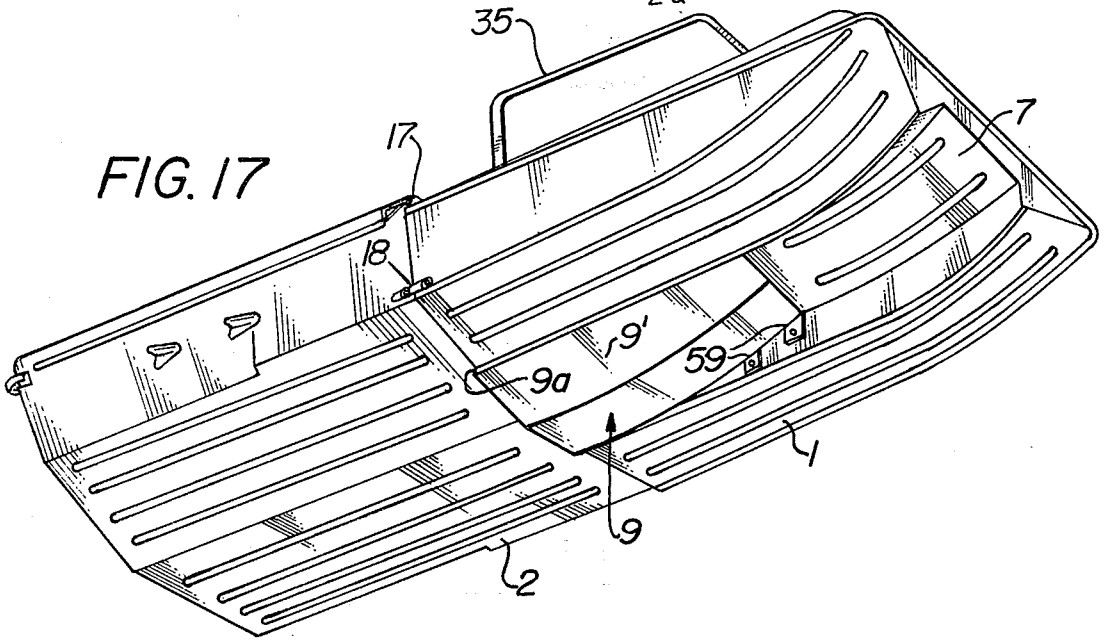
FIG. 17 is a bottom perspective view of the boat configuration of FIG. 11.

According to the invention, the hydroplate 9 is made hollow, its under side 9′ is shaped with a deadrise increasing toward the after part 2, and the upper side 9″ is flat so that said hydroplate may be used ashore as a tabletop. Apart from this, the hydroplate 9 is intended to be used as a cover to close an aperture in the front wall of the trailer 3 (FIGS. 4 and 5).

Mounted on the side walls of the hydroplate 9 are locks 59 for attaching the hydroplate in the tunnel 7 of the catamaran 1 and to the front wall 2*b* of the trailer 3.

The fore part 1 and the after part 2 of the boat are each constructed in the form of a metal hull made up of transverse frames 10 (FIG. 1) and a skin with fore-and-aft projections (not shown) to serve as longitudinal strength elements. Said projections form longitudinal steps 11 (FIG. 9) on the bottoms of the hulls.

Figure 8:
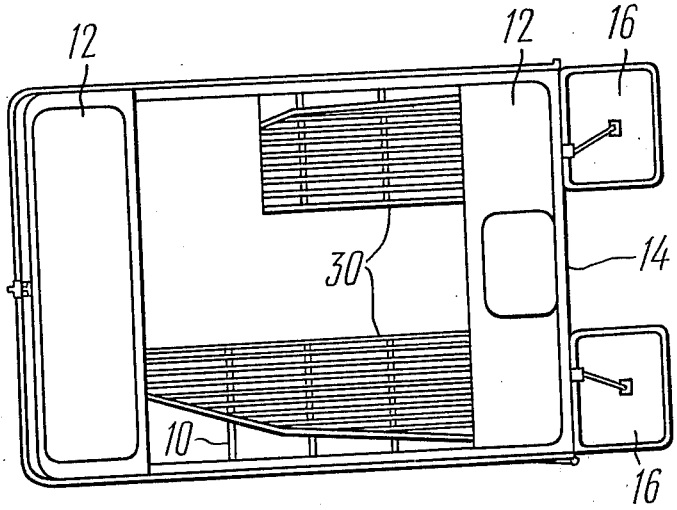
FIG. 8 is a top view of the fore part (catamaran).

Fitted in the bow and stern of the catamaran 1 and in the stern of the after part 2 are watertight compartments 12 (FIG. 8) which ensure unsinkability of the complete boat and of the catamaran 1 when used separately.

To provide for mounting an outboard motor 13 (FIG. 1), transom boards 14 (FIGS. 1 and 8) are attached to the stern frames 10 of both the fore part 1 and the after part 2.

Figure 7:
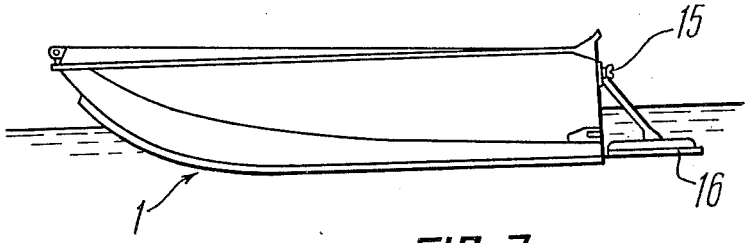
FIG. 7 is a side view of the fore part (catamaran).

The stern frame 10 of the catamaran 1 has locks 15 (FIG. 7) for the attachment of two removable antisquat boards 16. Said antisquat boards are intended to improve longitudinal stability of the catamaran 1, particularly in planing by the propulsion of the outboard motor 13, and are arranged for mounting substantially level with the side portions 8 of the catamaran bottom.

According to the invention, the fore part 1 and the after part 2 are coupled by means of two upper separable joints 17 (FIG. 11) and two lower separable attachment fittings 18. The upper joints form pivots for the fore part 1 to be turned about in folding it down onto the after part 2 to form the trailer 3.

Figures 14, 15, 16:
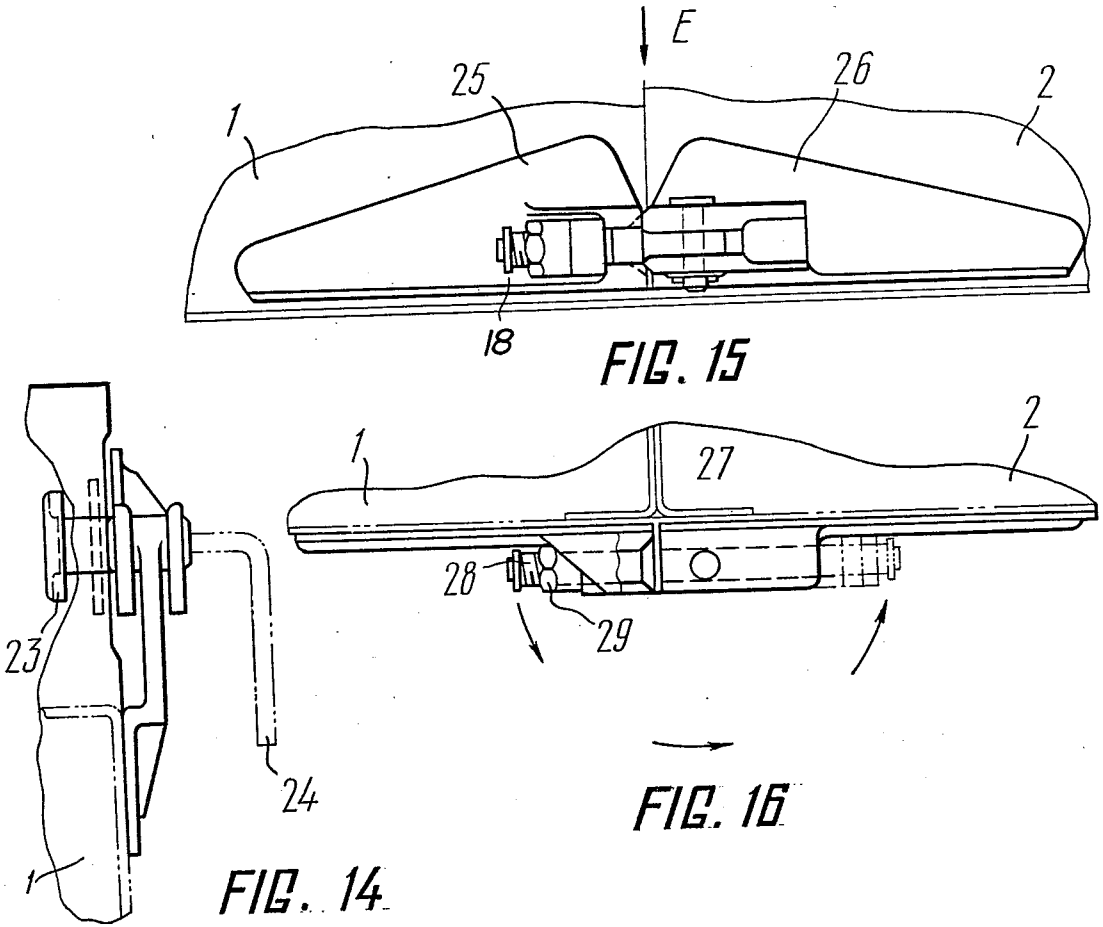
FIG. 14 is a view in the direction of the arrow D in FIG. 12.
FIG. 15 is detail B of FIG. 11 showing the lower separable attachment fitting (enlarged).
FIG. 16 is a view in the direction of the arrow E in FIG. 15.

Each upper joint 17 comprises a bracket 19 and a bracket 20. The bracket 19 is mounted on the side of the fore part and carries a cylindrical sleeve 21. The bracket 20 is mounted on the side of the after part 2 and carries a hook-shaped yoke 22 adapted to engage the sleeve 21. After the engagement, the two members are secured with a screw 23 (FIG. 14) by means of a wrench 24.

Each lower attachment fitting 18 comprises a bracket 25 and a bracket 26. The bracket 25 is mounted on the side of the fore part 1 and has a tapered seat 27 adapted to receive a corresponding tapered projection provided on the bracket 26 which is mounted on the side of the after part 2. Pivoted to the bracket 26 is a swivel bolt 28 with nuts 29 by means of which the brackets 25 and 26 are held together.

The equipment of the collapsible trailer boat comprises removable foot gratings 30 (FIG. 2) and two soft benches 31 placed along the sides of the after part 2. Said benches can be readily converted into berths with two matresses (not shown). The matresses can be used on the deck of the fore part to provide sleeping accommodating for another two persons. Stowage places 32 are located under the benches 31, under the deck panel of the fore part and between the water-tight compartments 12 in the after part 2. A helmsman's seat is located in the stern near the motor 13.

The boat equipment also includes a removable table 34 (FIG. 2), guardrails 35 (FIG. 1), a removable gang ladder to enter the water, and facing panels 36.

Stowage for a fuel tank 37 and a fuel can is provided in the stern of the after part 2. Oars 3 are placed along the sides of the fore part 1.

Figure 3:
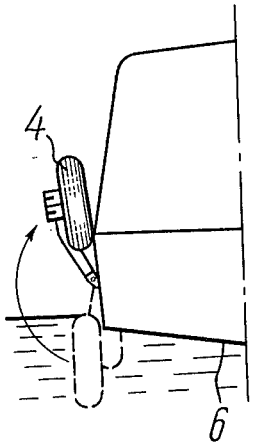
FIG. 3 is a sectional view taken on line III—III of FIG. 1.

The undercarriage 4 comprises two wheels which are pivotable about the hull between the retracted position shown in solid lines in FIG. 3 and the extended position shown in dotted lines in FIG. 3. It serves the purpose of trailering, putting the boat afloat and getting it ashore. The undercarriage suspension is of the independent, spring and arm type. The undercarriage wheels are mounted on articulated struts and adapted to be tilted up, out of the water, in which position they can be fastened to the sides of the after part 2.

The towbar 5 is adapted for quick removal and is provided with a ball-type hitch 39 for coupling to the tractor vehicle.

The after part 2 is provided with commonly known trailer electrical equipment which includes signalling lights 40 arranged to be fed from the electrical system of the tractor vehicle.

Figure 2:
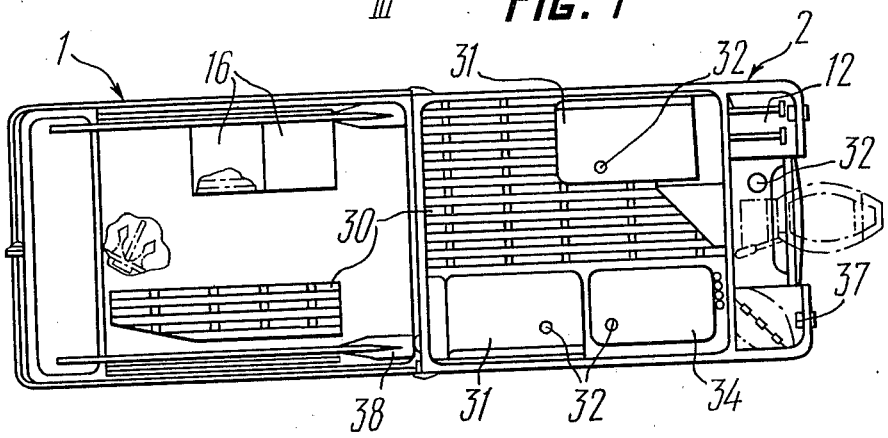
FIG. 2 is a top view of the collapsible trailer boat without a tent.

The boat is provided with soft-lined cradles 41 for the purpose of supporting the craft when it is kept on the land with the undercarriage retracted as shown in FIG. 1.

The boat is provided with a folding tent 42 of man's height. The tent is arranged to form a two-room home in conjunction with the boat. When the after part 2 is used separately, the tent 42 forms a single-room home with a canopy.

The boat constructed according to the present invention can be put to the following uses: a floating recreaction home; a two-room camping home for use on land; a recreational motorboat (with the camping and towing equipment removed); a single-room home with a canopy (when using the after part separately); a planing catamaran adapted to be propelled by power or by rowing (when using the fore part separately).

The two last-mentioned uses can be effected simultaneously, this being the main advantage featured by the invention.

To unfold the trailer 3 (FIG. 4) for the purpose of making a two-room land camper, the hydroplate 9 is removed, the locks which hold the fore part 1 folded down onto the after part 2 are disengaged, the fore part 1 is pivoted about the upper joints 17 (FIG. 11) until the brackets 25 and 26 of the lower attachment fittings 18 meet and thereafter they are secured together with the bolt 28 and nut 29. The tent 42 is removed from its stowage in the after part 2 and is erected. To camp for a short time, the cradles 41 are placed under the wheels of the undercarriage 4, in which case the boat will rest on the ground by the wheels and the bottom of the fore part 1.

For camping for a long time, the undercarriage wheels are retracted and fixed in the upper position as shown in FIG. 3. The boat is placed on the cradles 41 (FIG. 1). The hydroplate 9 can be fitted with legs to form a table.

To prepare the boat for camping afloat, the following operations are carried out in addition to those described above:

Remove the towbar 5 and close the tunnel 7 in the catamaran 1 with the hydroplate 9. Open the rear cover of the after part 2 and mount the motor 13 on the transom board 14.

Next the boat is wheeled into the water, with the stern ahead (the motor 13 will serve as a counterweight, facilitating the operation). After the boat is put afloat, the undercarriage wheels are tilted up and fastened to the sides of the after part 2.

In order to use both the fore part 1 and after part 2 separately, disconnect them by taking apart the upper joints 17. For the purpose, using the wrench 24 (FIG. 14), remove the screw 23 from the sleeve 21 and thereafter disconnect the brackets 19 and 20. Remove the fore part 1 from the after part 2 and put it afloat. Place the after part 2 on the cradles 41 and erect the tent 42.

With the camping and towing equipment removed, the boat becomes a high-speed planing pleasure craft.

What is claimed is:

1. A collapsible trailer boat adapted to be powered by an outboard motor and comprising: an after part the hull of which is shaped with a flat deadrise and has provision for mounting said outboard motor; a fore part jointed to said after part in such a manner that they can be folded to form a trailer by pivotally moving said fore part in the longitudinal centerplane until it rests, with its bottom up, on said after part; a retractable undercarriage mounted on said after part; a removable towbar mounted on said after part and adapted for hitching said trailer to a vehicle; said fore part being detachable from said after part, which fore part has a hull in the form of a planing catamaran with a tunnel and is adapted for use as a separate craft; a removable hydroplate which, for the purpose of using the complete boat bodily, is shaped to close the portion of said catamaran tunnel adjacent to the after part and to conform the shape of the bottom of said catamaran to the shape of the bottom of said after part, said hydroplate forming a transverse step at the junction of said fore and after parts, a gap being provided at said step for water to be drawn from the said catamaran tunnel when the craft is planing.

2. A boat as claimed in claim 1, comprising a transom board attached to the stern of the catamaran for mounting said outboard motor and two antisquat boards arranged to be positioned substantially level with the catamaran bottom, one on each side of the tunnel thereof, said antisquat boards being intended to improve the longitudinal stability of the catamaran and to be employed as a portion of the deck planking when the complete boat is used bodily.

3. A boat as claimed in claim 1, wherein the hydroplate is hollow, its under side being shaped with a deadrise increasing toward the after part, and the upper side being flat so that said hydroplate may be used ashore as a tabletop.

4. A boat as claimed in claim 1, wherein said fore and after parts are detachably jointed by means of two upper separable joints, each comprising a hook-shaped yoke, and two lower separable attachment fittings employing swivel bolts.

* * * * *